US005666705A

United States Patent [19]

Semon

[11] Patent Number: 5,666,705

[45] Date of Patent: Sep. 16, 1997

[54] ABOVE GROUND ENTOMBMENT CASKET

[75] Inventor: Joseph R. Semon, Clarks Summit, Pa.

[73] Assignee: Casket Shells, Incorporated, Eynon, Pa.

[21] Appl. No.: 546,670

[22] Filed: Oct. 23, 1995

[51] Int. Cl.[6] ..... A61G 17/00

[52] U.S. Cl. ..... 27/19; 27/6

[58] Field of Search ..... 27/6, 19, 2, 35, 27/1, 11

[56] References Cited

U.S. PATENT DOCUMENTS 3,964,140 6/1976 Gauchard ..... 27/35 X 5,444,900 8/1995 Shawhan et al. ..... 27/1 X

*Primary Examiner*—Kien T. Nguyen

*Attorney, Agent, or Firm*—Kane, Dalsimer, Sullivan, Kurucz, Levy, Eisele and Richard, LLP

[57] ABSTRACT

A metal casket for an above ground entombment includes a barrier material on the inner face of the casket bottom, sides and ends for preventing body decomposition liquids and vapors for contacting the inner surface of the casket bottom, sides and ends. A crystalline coating material is adhered to the barrier material and acts as a desiccant and encapsulator of the body decomposition liquids and vapors to convert the liquids and vapors into gel so that the liquids and vapors cannot migrate by gravity to the exterior of the casket.

9 Claims, 1 Drawing Sheet

ABOVE GROUND ENTOMBMENT CASKET

BACKGROUND OF THE INVENTION

The use of metal caskets for above ground entombment (mausoleum) is becoming more prevalent in today's market place. Studies have shown that the forces at work during decomposition in mausoleum entombments are so powerful that they overcome the strongest conventional caskets made today causing degradation of the metal and leakage of the body fluids onto the mausoleum floor. Precautions have been attempted in the past to minimize the effects of these forces and body fluids on the metal, such as trays of the type disclosed in commonly assigned U.S. Pat. No. 4,949,439 granted on Aug. 21, 1990. However, the cost to insure each casket in this manner is prohibited or is not economically feasible since such protection is only necessary for above ground entombments. Normally when a casket is manufactured, it is not known before hand whether or not this casket will be for an above ground entombment or below ground burial. Moreover, a tray or liner is not the solution because of condensation that takes place at night when temperatures drop to a low enough level to cause moisture vapor to condense and form droplets on the metal itself. At this point, the tray or liner becomes ineffective.

SUMMARY OF THE INVENTION

A principal object of the present invention is to provide a fluid tight barrier material between decomposition fluids and fluid vapors and the virgin steel or metal of the casket and a coating, layer or film of material over and/or into the barrier that captures, stabilizes, solidifies or gels the fluids so that they cannot migrate out of the casket.

A further object is to provide a barrier material and coating material of the foregoing type in which the barrier material serves to neutralize the acidic properties of body decomposition fluids as well as destroy any bacterial growth with the coating material further acting as a desiccant and encapsulator which will convert body fluids into gel so that these fluids cannot migrate by gravity.

Other objects and advantages will become apparent from the following detailed description.

DETAILED DESCRIPTION

Figure 1:
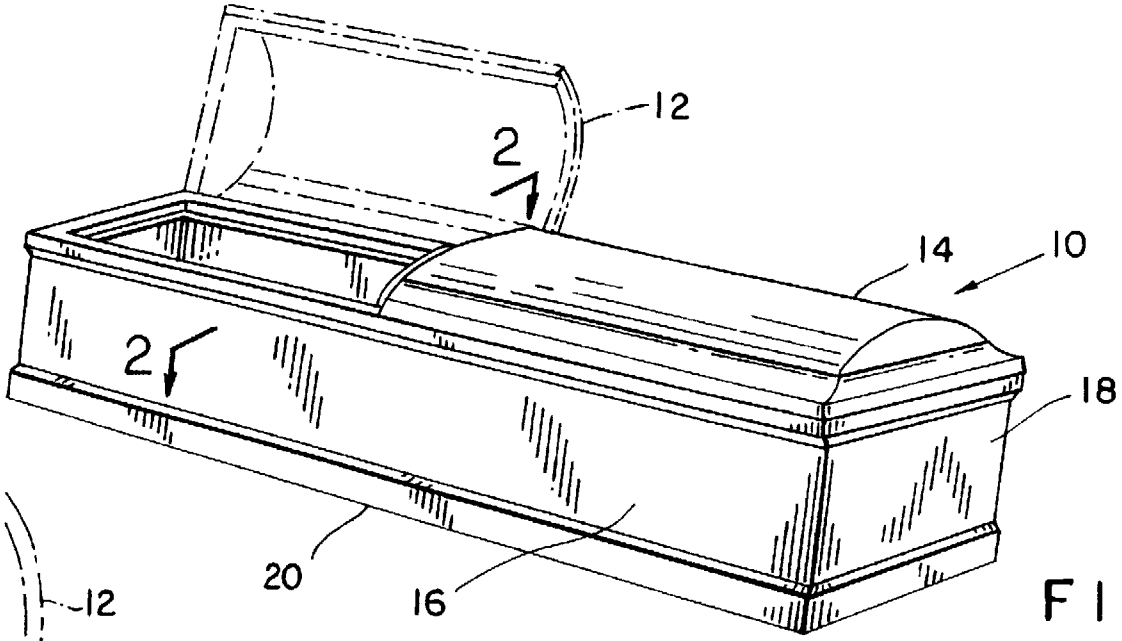
FIG. 1 is a perspective view of a conventional metal perfection casket incorporating the teachings of the present invention, with an open lid section shown in phantom.

Referring now to the drawings, a conventional stamped metal perfection casket 10 is shown with an open lid section 12 and a closed lid section 14. For simplicity purposes, the stamped parts are illustrated schematically and will include sides 16, ends 18 and a bottom 20. It should also be understood that other styles of caskets and even caskets of different materials may adopt the teachings of the present invention.

In accordance with this invention a barrier material 22 is coated on the inside and particularly the inner exposed metal surfaces of the casket by spraying, brushing or any other effective application process. A commercially acceptable, successful and satisfactory barrier material is obtained from Ameritech, a division of American Industries Technologies, Inc. of Addison, Ill. under the trade name "Coregard" which has the ability to neutralize body decomposition liquid and fluids and prevents acidic corrosion of the casket. This barrier material also serves to neutralize alkaline properties of such fluid and may also contain a bacteriacide to prevent microbial growth within the casket. The Coregard type barrier material is described in detail in U.S. Pat. 4,448,826 granted May 15, 1984. Suffice it to say in preparing the barrier material, granular or powdered alkaline material, such as the metal oxides, carbonates and bicarbonates, are added to water, along with a wetting agent and mixed at high speed to obtain a slurry. A thickener, as well as a resin film former can be added during the mixing. Following this, coalescing agents, anti-freeze, coloring material, and sodium nitrite deoxidizer can then be added to the emulsion and the PH adjusted through the addition of a material, such as ammonium hydroxide. The composition is then applied to the metal casket by spraying, rolling, brushing, or dipping, and on evaporation of the water, or other carrier, a thin continuous coating is produced.

The preferred formulation by weight percent thereof is in Example IV and is repeated below.

EXAMPLE IV

| | |
|---|---|
| Acrylic styrene copolymer | 23.6 |
| Water | 28.0 |
| Ethylene glycol | 2.2 |
| Calcium carbonate | 44.2 |
| Zinc oxide | 1.3 |
| 2-n-oxtyl-4-isothiazoline-3-one (microbrocide) | 0.2 |
| Sodium carboxylated poly-electrolyte | 0.1 |
| Hydroxyethyl cellulose | 0.3 |
| Ammonium hydroxide | 0.1 |
| | 100.00 |

In a successful application of the present invention the barrier material was sprayed on the inside surfaces of the bottom and sides of a metal casket to a thickness of approximately 5–10 mils. This spraying can take place during the exterior paint application during the manufacturing process and about 1–2 pints and even up to 1 quart of barrier material is used per casket. If desired, the lid can also be sprayed with the barrier material.

Figure 3:
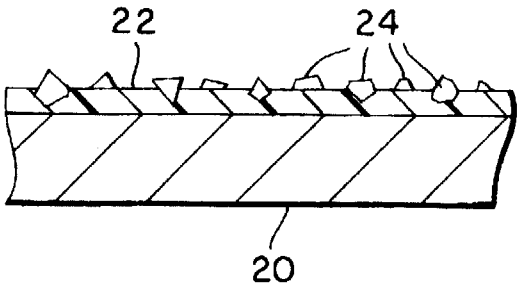
FIG. 3 is an enlarged fragmentary sectional view of the casket bottom having applied barrier material and coating material.
Figure 2:
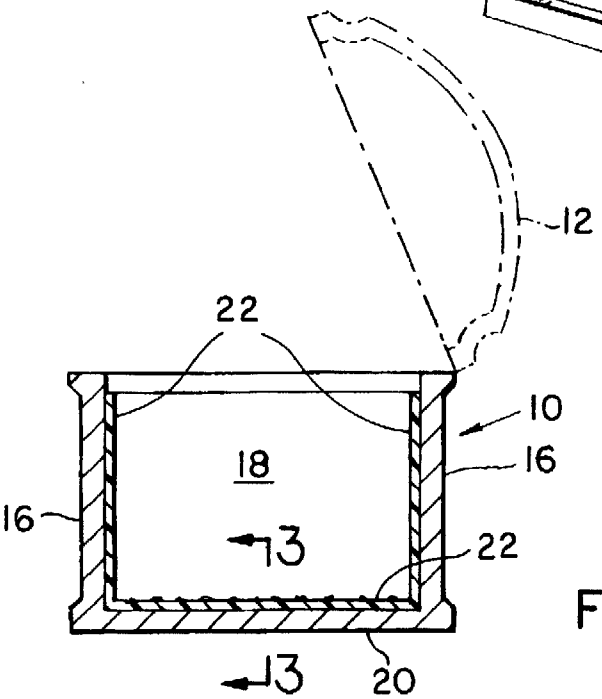
FIG. 2 is a sectional view taken along the line 2—2 showing the casket stamped metal parts schematically and with the applied barrier material and coating material of this invention.

Before the barrier dries to touch, crystals 24 of an absorbent material are applied as a coating or film to the barrier material in order for the crystals to adhere to and be embedded in the barrier material as shown in FIG. 3. A successful crystalline material is supplied commercially by Medzans, a division of Safetec of America, Inc. of Buffalo, N.Y. under the trade name "Green-Z". These crystals are potassium/sodium polyacrylate absorbent polymer, lightly crosslinked. The particle size of the crystals with the weight % on a passing U.S. Standard Mesh is as follows:

680–106 Micron Nominal Size Range
on 18 (1000 Micron): 1% Maximum
on 20 (850 Micron): 1% Maximum
Passing 140 (106 Micron): 3% Maximum
Passing 200 (75 Micron): 1% Maximum In a successful application of the invention 8–10 ounces of crystals were sprinkled onto the bottom of the casket before the barrier material dried to touch in order for the crystal to adhere to this surface.

Cost would prohibit the application of the barrier material and crystals to each metal casket. Therefore, it is recommended that after the metal casket is manufactured and when it is ascertained that it will be used for above ground entombment, the following procedure should be followed. The casket interior is lifted out of the casket and provisions are made for the interior fabric not to be wetted by the barrier material. Approximately one quart of barrier material is sprayed onto the inside surfaces of the bottom and sides of the metal casket so that these surfaces are adequately coated. All cracks, crevices, and metal surfaces up to three inches from the top of the casket ledge should be coated. Any excess should be directly sprayed into the bottom channel where the bottom and sides/ends of the casket meet. Before the barrier material dries, sprinkle crystals of the absorbent material. It has been found that in practice only the bottom interior coated surfaces of the casket need be coated with the crystals and it is not necessary to apply crystal to the sides/ends of the casket. Crystals can be concentrated in all joints and seams. Once the barrier coating material sets up, or is dry to the touch (approximately one hour) the casket is ready to have the interior bed reinstated and the front drop interior flipped back into the casket.

Accordingly, the barrier material protects the casket in the following manner:

a. It provides a barrier that adheres right on the surface of the metal insuring that condensation does not come in contact with it.

b. It neutralizes the decomposition fluid effects on the metal whether it be acidic or alkaline in nature.

c. It contains a bactericide that kills bacteria that also attacks the metal.

The absorbent crystals act as a desiccant and encapsulator which will convert body fluids into gel so that these fluids will not migrate. In addition, the crystals provide slower evaporation of these fluids.

Thus, the several aforementioned advantages and objects are most effectively attained. Although a single somewhat preferred embodiment of the invention has been disclosed and described in detail herein, it should be understood that this invention is in no sense limited thereby and its scope is to be determined by that of the appended claims.

I claim:

1. A metal casket for an above ground entombment in which decomposition liquids and vapors are generated from decomposition of a deceased body comprising, a bottom and sides and ends connected thereto, and each having an inner surface, a barrier material adhered on the inner surface of the bottom for cooperating in preventing the decomposition liquids and vapors from contacting the inner surface of the bottom, and crystals of a coating material adhered to and embedded in the barrier material acting as a desiccant and encapsulator of the body decomposition liquids and vapors to convert these liquids and vapors into a gel on the casket bottom so that the liquids and vapors cannot migrate by gravity to the exterior of the casket, the crystals adhered to and embedded in the barrier material by applying the crystals to the barrier material before the barrier material is dry to touch.

2. The invention in accordance with claim 1 wherein the barrier material is sprayed on the inner surface of the bottom.

3. The invention in accordance with claim 1 wherein the barrier material is on the inner surface of the sides and ends.

4. The invention in accordance with claim 3 wherein the barrier material is sprayed on the inner surface of the bottom, sides and ends.

5. The invention in accordance with claim 1 wherein the barrier material includes an alkaline material to neutralize the decomposition liquids and vapors.

6. The invention in accordance with claim 1 wherein the barrier material includes a bactericide to inhibit microbial growth in the casket.

7. The invention in accordance with claim 1 wherein the coating material is a potassium/sodium, polyacrylate absorbent polymer, lightly crosslinked.

8. The invention in accordance with claim 1 wherein the barrier material is on to the inner surface of the sides and ends, the barrier material includes an alkaline material to neutralize the decomposition liquids and vapors, the coating material is a potassium/sodium, polyacrylate absorbent polymer, lightly crosslinked.

9. The invention in accordance with claim 8 wherein the barrier material is sprayed on the inner surface of the bottom, sides and ends, the barrier material includes a bacteriacide to inhibit microbial growth in the casket, the coating material is in crystalline form.

* * * * *